United States Patent [19]

McStravick et al.

[11] 4,315,185

[45] Feb. 9, 1982

[54] VACUUM-TIGHT, ELECTRICAL CONNECTION FOR THE PHOTOCATHODE IN AN IMAGE INTENSIFIER TUBE

[75] Inventors: Terence C. McStravick, Leutingewolde; Peter Sipkes, Roden, both of Netherlands

[73] Assignee: N.V. Optische Industrie "De Oude Delft", Delft, Netherlands

[21] Appl. No.: 33,985

[22] Filed: Apr. 27, 1979

[30] Foreign Application Priority Data

Apr. 28, 1978 [NL] Netherlands ..... 7804640

[51] Int. Cl.[3] ..... H01J 40/02

[52] U.S. Cl. ..... 313/102

[58] Field of Search ..... 313/101, 102, 94, 384

[56] References Cited

U.S. PATENT DOCUMENTS

| | | | |
|---|---|---|---|
| Re. 29,233 | 5/1977 | Cuelenaere et al. | 313/102 |
| 1,837,744 | 0/1931 | Zworykin | 313/102 X |
| 2,064,369 | 0/1936 | Biggs | 313/102 X |
| 3,280,356 | 0/1966 | Stoudenheimer et al. | 313/102 X |
| 3,337,830 | 8/1967 | Levy | 313/94 X |
| 3,408,522 | 0/1968 | Casamo et al. | 313/101 X |
| 3,693,013 | 9/1972 | Dueker | 313/384 X |

FOREIGN PATENT DOCUMENTS

| | | | |
|---|---|---|---|
| 1401434 | 7/1975 | United Kingdom | 313/101 |

*Primary Examiner*—Robert Segal

*Attorney, Agent, or Firm*—O'Brien & Marks

[57] ABSTRACT

Electrical connection for the photocathode in an image intensifier tube, said photocathode being present on the input window of the image intensifier tube, and which input window is secured by means of a layer of vacuum-tight material, e.g. frit, to a metallic cathode flange, which in turn is secured to the outer wall of the image intensifier tube, and in which the electrical conducting lead effecting the connection is passed via the frit layer to the outside of the image intensifier tube, and in which means are provided for keeping the electrical conducting lead clear of the input window and/or the cathode flange at least at one place along its length through the frit layer.

5 Claims, 6 Drawing Figures

VACUUM-TIGHT, ELECTRICAL CONNECTION FOR THE PHOTOCATHODE IN AN IMAGE INTENSIFIER TUBE

The invention relates to a vacuum-tight, electrical connection for the photocathode in an image intensifier tube, the input window of which is secured by means of a vacuum-tight layer of material, e.g. frit, to a metallic cathode flange, which in turn is connected in a vacuum-tight manner to the outer wall of the image intensifier tube, and in which the electrical conducting lead effecting the connection is passed via the frit layer to the outside of the image intensifier tube.

In image intensifier tubes, a photocathode is used, which by electron-optical means is depicted on an anode likewise present in the tube. The electron-optical picture is brought about by one or more electrodes, which are adjusted to the correct electrical voltage. These voltages are supplied by a device generally disposed outside the tube, and are applied to the electrodes referred to via passages through the wall of the image tube.

In some cases it is necessary for the photocathode itself to be connected to an electrical system outside the tube. For example an image intensifier tube as used in a device with which objects of low luminosity can be observed at night and in darkness without any auxiliary illumination. This is possible owing to the great light intensification that takes place in the tube. If the cathode of such a device is suddenly exposed to an intense light, e.g. owing to the switching on of lamps, the explosion of ammunition, fire balls and the like, the undesirable result of the great light intensification is that the anode is damaged owing to the overexposure caused there.

This drawback can be remedied with an apparatus described in the Dutch patent application No. 7315716, U.S. Pat. No. Re. 29,233, May 24, 1977 in which the photocathode is directly connected to an electrical system according to that application, which system is located outside the tube.

Now, the image intensifier tubes concerned are mostly so constructed that the photocathode is applied to a glass carrier, the input widow, which by means of a frit layer is connected in vacuumtight fashion to the wall of the image tube.

The electrical passage from the cathode to the outside of the tube is then brought about by a conducting lead which extends outwards through the frit layer. As the connecting lead is often pressed against the input window body during the fritting process, the space at that point is not always adequately filled with frit material. If this happens throughout the entire length of the wire in the frit material, the required vacuum tightness is not obtained.

It is an object of the invention to provide for an improvement in this respect.

For this purpose the electrical connection according to the invention is characterized in that means are provided for keeping the electrical conducting lead clear of the input window and/or the cathode flange at least at one place along its length through the frit layer.

One of these means according to the invention consists of at least one cavity in the input window, which cavity is filled with frit and is located between, and spaced from, the edge of the photocathode and the outer wall of the input window, the electrical conducting lead which effects the connection extending across the cavity and being embedded in the first layer with which the input window is sealed to the cathode flange. It is thus acheived that the lead remains free from the input window throughout the surface of the cavity, with the result that the vacuum tightness at the boundary layer between the frit layer and the input window is substantially improved.

By virtue of the construction according to the invention, the vacuum tightness, in practically all specimens, proves to be satisfactory, whereas without the provision concerned there is a high percentage of rejects for insufficient vacuum tightness.

In a preferred embodiment of the electrical connection according to the invention, the electrical connecting lead is accommodated in a slot extending from the photocathode via the cavity to the outside of the input window and subsequently along that outside to the boundary surface of the input window remote from the photocathode.

In another embodiment of the electrical connection according to the invention, means consist of at least one relatively large change in diameter of the connecting lead in the frit layer over a short length, and this such that in the vicinity of this charge the space between the connecting lead and the intput window can be filled with frit with certainty.

According to the invention the electrical conducting lead in the frit layer may be provided with an envelope extending over a part of the length of the lead and being so thick that in the vicinity of this envelope the electrical conducting lead remains free from the input window and/or the cathode flange.

The invention will be described in more detail with reference to the accompanying drawings. In said drawings.

Figure 1:
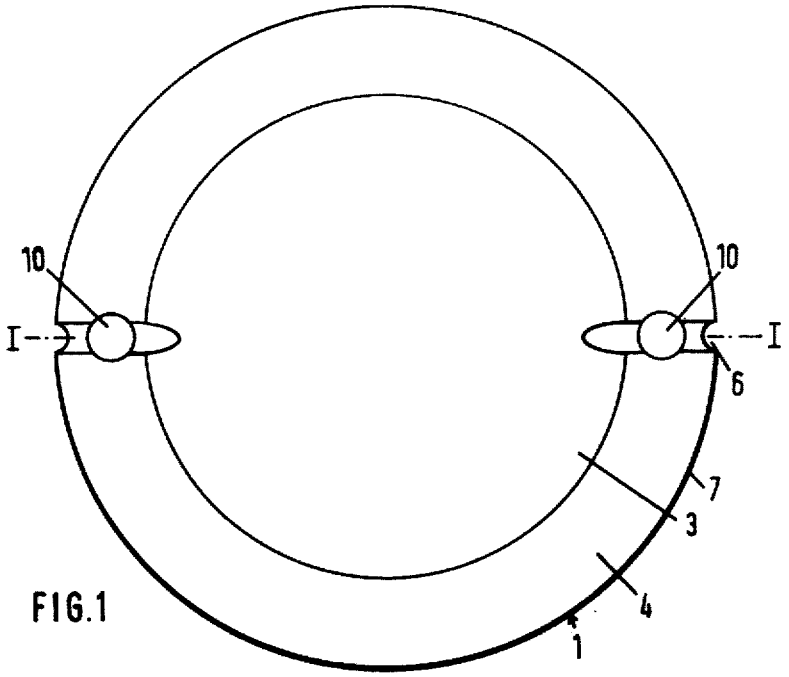
FIG. 1 shows a plan view of the input window for an image intensifier tube according to the invention.
Figure 2:
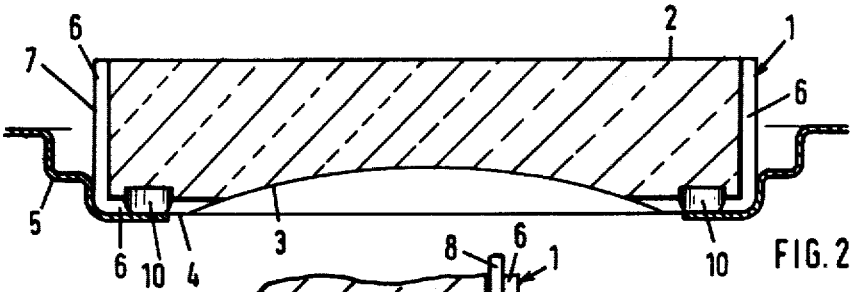
FIG. 2 shows a cross-sectional view on I—I of the input window shown in FIG. 1.
Figure 3:
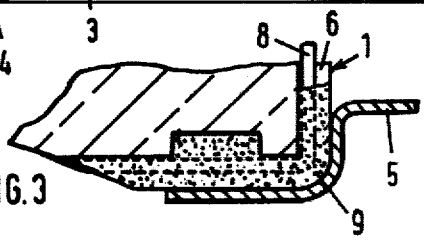
FIG. 3 shows an enlarged detailed view from FIG. 2 of the edge of the input window, showing the electrical connecting lead placed in position.

FIGS. 1 and 2 show the input window 1 of an image intensifier tube having an input surface 2 and a curved cathode area 3. The input window often consists of a fibre plate. On the curved cathode area 3 the photocathode is formed. Surrounding the cathode area 3 is a flat portion 4 by which the input window 1 is connected to a cathode flange 5. Provided in the flat portion 4 between the cathode area 3 and the outer wall 7 of input window 1 is a slot 6, which extends into wall 7 in the direction of input surface 2 to serve, as shown in FIG. 3, as a passageway for an electrically conductive lead 8, which connects the photocathode to a source of voltage, not shown, outside the image intensifier tube. The frit layer 9, by which the input window 1 is connected in a vacuum-tight manner to cathode flange 5 also secures lead 8 in slot 6 in input window 1.

It often occurs, however, that before and during the fritting process lead 8 makes contact with the surface of slot 6. Where this happens the space between and adjacent lead 8 and input window 1 cannot be filled with frit on account of the high viscosity of the frit material, and if this occurs throughout the length of lead 8 in slot 6, the possibility of a leak in the vacuum-tight seal of the tube is extremely high. For that reason, in the embodiment according to the invention as shown a cavity 10 has been made in slot 6 in the flat portion 4, which cavity is deeper and wider than slot 6. Thus it is ensured that at this position the electrically conductive lead 8 is clear of input window 1.

During the fritting process cavity 10 is entirely filled with frit, so that at any rate at that position the vacuum tightness at the boundary layer between the frit layer 9 and input window 1 is not reduced by the proximity of the electrical conducting lead.

It is noted that cavity 10 may have any configuration, as long as it is deeper and wider than slot 6.

Figure 4:
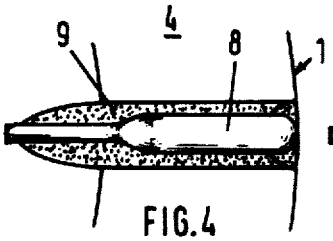
FIG. 4 shows the electrical connecting lead with a marked partial reduction in diameter.
Figure 5:
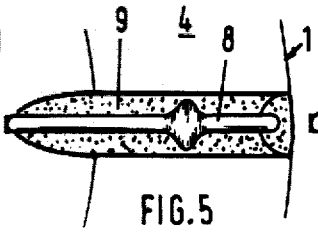
FIG. 5 shows the electrical connecting lead with a marked partial increase in diameter.
Figure 6:
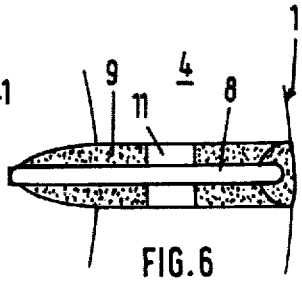
FIG. 6 shows the electrical connecting lead provided with an envelope.

In the figures so far described, the means used in accordance with the invention relate to input window 1. FIGS. 4, 5 and 6 show, however, that electrical connecting lead 8, too, can be adapted to secure better vacuum tightness at the boundary layer of frit layer 9 and input window 1. FIG. 4 gives an example of an electrical connecting lead 8 which has been reduced in diameter over a short length. This can be realized by stretching the lead over a short length. All this naturally depends on the material characteristics of the lead and the physical conditioning to which it is subjected.

The same applies to the local thickening of lead 8, shown in FIG. 5. A variant of this is shown in FIG. 6, which shows an envelope 11 around the lead in a portion of slot 6. This envelope 11 can be secured to lead 8 by for example pressing or soldering. The essential point is that modification of, and/or to, lead 8, as for example thickening, thinning or bossing, ensures that a portion of lead 8, in the vicinity of said modification, is in such spaced relationship to the face plate that at that portion the sealing material, e.g. frit, can flow between lead 8 and the surface of the face plate to ensure a vacuum-tight seal with the face plate. Still another possibility (not shown) for the solution of the problem of the vacuum-tight seal of the tube at the boundary layer between the frit layer and the input window is the provision of one or more bends in wire 8 in slot 6. All these kinds of possibilities are based on the provision, according to the invention, of one or more discontinuities in or at lead 8 in slot 6.

We claim:

1. In an image intensifier tube, a structure comprising
an input window,
a photocathode on the input window,
a metallic cathode flange,
a layer of sealing material securing the input window in vacuum-tight relation to the metallic cathode flange,
an electrical conducting lead having a length passing between the window and the flange and through the layer of sealing material with one end adapted to be connected to a source of potential and with an opposite end connected to the photocathode, and
means spacing the lead from the window and the flange at at least one portion of the length of the lead so that said sealing material completely surrounds and seals the lead at the one portion,
said means including at least one cavity in the input window, which cavity is filled with the sealing material and is located between the edge of the photocathode and the outer edge of the input window and in spaced relationship to these edges so as to extend only partially along the lead length between the window and the flange, the one portion of the electrical conducting lead extending through said cavity and being embedded in the layer of sealing material with which the input window is sealed to the cathode flange.

2. The invention as claimed in claim 1 wherein said means includes a slot in the input window accommodating the electrical conducting lead and extending from the photocathode via the cavity to the outside of the input window and subsequently along that outside to the boundary surface of the input window remote from the photocathode.

3. In an image intensifier tube, a structure comprising
an input window,
a photocathode on the input window,
a metallic cathode flange,
a layer of sealing material securing the input window in vacuum-tight relation to the metallic cathode flange,
an electrical conducting lead having a length passing between the window and the flange and through the layer of sealing material with one end adapted to be connected to a source of potential and with an opposite end connected to the photocathode, and
means spacing the lead from the window and the flange at at least one portion of the length of the lead so that said sealing material completely surrounds and seals the lead at the one portion ,
said means including at least one change in diameter of the electrical conducting lead over a portion of its length in the layer of sealing material, said change in diameter being such that in the vicinity of this change the space between said lead and the input window and the cathode flange is filled up with the sealing material.

4. In an image intensifier tube, a structure comprising
an input window,
a metallic cathode flange,
a layer of sealing material securing the input window a vacuum-tight relation to the metallic cathode flange,
an electrical conducting lead having a length passing between the window and the flange and through the layer of sealing material with one end adapted to be connected to a source of potential and with an opposite end connected to the photocathode, and
means spacing the lead from the window and the flange at at least one portion of the length of the lead so that said sealing material completely surrounds and seals the lead at the one portion,
said means including an envelope extending over a portion of the length of the lead and being so thick that in the vicinity adjacent to this envelope the electrical lead is spaced from the input window and the cathode flange.

5. The invention as claimed in claim 1, 2, 3, or 4 wherein the sealing material is a frit.

* * * * *